US006802177B2

(12) United States Patent
Rosenwasser et al.

(10) Patent No.: US 6,802,177 B2
(45) Date of Patent: Oct. 12, 2004

(54) LINK WITH OFFSET GAP

(75) Inventors: David Rosenwasser, Norwood, NJ (US); Avraham Moshe Rosenwasser, 100 Rio Vista Dr., Norwood, NJ (US) 07648

(73) Assignee: Avraham Moshe Rosenwasser, Norwood, NJ (US)

( * ) Notice: Subject to any disclaimer, the term of this patent is extended or adjusted under 35 U.S.C. 154(b) by 0 days.

(21) Appl. No.: 10/313,529

(22) Filed: Dec. 6, 2002

(65) Prior Publication Data

US 2004/0107689 A1 Jun. 10, 2004

(51) Int. Cl.[7] ..... B21L 5/02
(52) U.S. Cl. ..... 59/80; 59/35.1; D11/13
(58) Field of Search ..... 59/80, 82, 35.1, 59/78; D11/13

(56) References Cited

U.S. PATENT DOCUMENTS 4,934,135 A 6/1990 Rozenwasser
4,996,835 A 3/1991 Rozenwasser
D329,828 S 9/1992 Bedoyan
5,309,704 A * 5/1994 Grando ..... 59/35.1
6,158,206 A * 12/2000 Rosenwasser et al. ..... 59/80
6,209,306 B1 4/2001 Chia et al.
6,389,790 B1 5/2002 Rosenwasser
6,481,196 B1 * 11/2002 Chia et al. ..... 59/80
6,532,725 B1 * 3/2003 Chia et al. ..... 59/35.1
6,560,955 B1 * 5/2003 Chia et al. ..... 59/80

* cited by examiner

*Primary Examiner*—David B. Jones
(74) *Attorney, Agent, or Firm*—Katten Muchin Zavis Rosenman

(57) ABSTRACT

A jewelry chain link suitable for intertwining with other jewelry chain links to form a jewelry chain comprises an inner periphery, an outer periphery, a thickness defined between the inner and outer peripheries and a gap extending between the inner and outer peripheries for intertwining one jewelry chain link with another. First and second outermost edge dimensions along the outer periphery are defined relative to a plane extending through the gap, such that the distance from the plane to each of the first and second outermost edges is different.

34 Claims, 7 Drawing Sheets

LINK WITH OFFSET GAP

FIELD OF THE INVENTION

This invention relates to a chain link for use in making jewelry chains, and more specifically, a chain link having an eccentric or offset gap.

BACKGROUND OF THE INVENTION

Conventional rope chain is formed by intertwining jewelry links 10 of the type illustrated in FIG. 2, which is used in the formation of rope chains, said link 10 having an outer periphery 12, an inner periphery 14, a gap 16 and a thickness 18. Link 10 may be formed from a solid or hollow wire 5 as is known in the art shown in FIG. 1, or may be formed by stamping or punching as is also known in the art. Other methods of link formation are known.

The link 10 of FIG. 2 used in the assembly of rope chains has certain conventional characteristics. First, the inner and outer peripheries 12 and 14 respectively usually have the same or similar shape, and in this case an annular configuration. The thickness 18 is also generally consistent throughout the link 10. In addition, the gap 16 falls on a centerline plane 30 that cuts the link 10 in half, such that a distance to a first outermost point 32 defined along a first plane 31 extending perpendicular to the centerline plane 30 is the same as a distance to a second outermost point 34 defined along a second plane 33 extending perpendicular to the centerline plane 30.

In other words, in a conventional link 10 having an annular configuration as shown in FIG. 2, the centerline plane 30 and the outermost dimensions 32, 34 will each fall on a diameter 35 of the link 10, such that the addition of the outermost dimensions 32, 34 from the centerline plane 30 will equal such diameter 35. The intertwining of such chain links 10 results in a chain 40 as illustrated in FIGS. 3 and 4, wherein the overall thickness of the chain 40 is substantially equal to the same diameter 35 of the chain link 10, or to the distance between the outermost dimensions 32, 34 (FIG. 2). Thus, the thickness 35 of the chain of FIG. 3 is directly related to the distance between the outermost dimensions 32, 34 of link 10 or the distance of each outermost dimension 32, 34 relative to the centerline plane 30.

The intertwining of chain links 10 as shown in FIG. 4 forms a double helical chain configuration as shown in FIG. 3. Thus, the chain appears to have two separate "helixes" of links, one helix designated in FIG. 3 by a small "○" and the other designated by a small "x". In conventional rope chain construction, each helix of material represents one side of an intertwined link. For instance, the "○" helix in FIG. 3 might represent the end 32 of link 10 illustrated in FIG. 2, while the "x" helix might represent the end 34 of link 10 illustrated in FIG. 2. As shown in FIG. 3, the "○" and "x" helixes appear to be dimensionally identical, which is due to the uniform distance between the center plane 30 and each outer edge 32, 34. This is also illustrated in FIG. 4, wherein a cross-section through a chain section has a uniform, circular diameter 35.

A conventional oblong link 50 as disclosed in U.S. Pat. No. 4,996,835 and illustrated herein in FIG. 5, having an inner periphery 52, outer periphery 54, thickness 56 and gap 58, when intertwined to form a chain illustrated in FIG. 6, will produce a chain thickness 65 equal to the distance between the outermost points 62, 64, which lie along planes 61, 63 relative to the centerline plane 60. The centerline plane 60 or gap plane 60 is generally defined through the gap 58 along a vertical axis that extends perpendicular to the major axis of the link and parallel to the minor axis of the link. As illustrated in FIG. 9, a jewelry rope chain is formed by successively intertwining chain links 50*a*–50*f* as is known in the art (i.e., in an alternating relation or by other methods known in the art, one such method being shown in U.S. Pat. No. 4,934,135 to Rozenwasser), the thickness 65 of the chain being determined by adding the distances of the outermost points 62*a*, 64*a* (see link 50*a* in FIG. 9 for example) relative to the gap plane 60. More particularly, it will be understood with reference to the discussion of the link of one embodiment of the present invention that the chain thickness 65 can be defined as the distance between outermost points of two successively intertwined chain links. In the case of the link 50 of FIG. 5, because the outermost points 62, 64 are at the same distance from the centerline plane 60, the chain width and the link width are the same.

However, the present inventors have discovered that by using a link wherein the distance between each outermost point relative to the centerline (gap) plane is not the same, a chain can be produced with a greater chain thickness than link width, but without using a greater amount of material in each link or chain. In other words, by eccentrically positioning the gap so that it does not fall along a plane that splits the link in half, a resultant chain width becomes greater than, and not substantially equal to, the major diameter of the link.

SUMMARY OF THE INVENTION

A jewelry chain link suitable for intertwining with other jewelry chain links to form a jewelry chain comprises an inner periphery, an outer periphery, a thickness defined between the inner and outer peripheries and a gap extending between the inner and outer peripheries for intertwining one jewelry chain link with another. First and second outermost edge dimensions along the outer periphery are defined relative to a plane extending through the gap, such that the distance from the plane to each of the first and second outermost edges is different.

DETAILED DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

FIGS. 7–19 illustrate various embodiments of links and chains formed in accordance with the teachings of the present invention. In each case, a link is formed with an offset gap as will be described in detail below. In one embodiment illustrated in FIG. 8, a chain is formed by alternately intertwining links of the invention, while in another embodiment illustrated in FIGS. 18–21, a chain is formed by non-alternately intertwining the links. Other methods of intertwining as is known in the art are contemplated.

Figure 7:
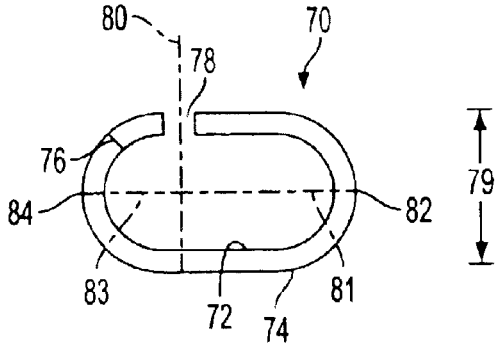
FIG. 7 is a front view of a link of the present invention.

FIG. 7 is a front view of one embodiment of a chain link 70 of the present invention, having an inner periphery 72, an outer periphery 74, a thickness 76 and a gap 78 defined between the inner and outer peripheries 72, 74. A gap plane 80 extending through the gap 78 divides link 70 relative to the outermost points 82, 84 on the outer periphery 74, with the distance 81 from the plane 80 to the outermost point 82 being greater than the distance 83 from the plane 80 to the outermost point 84. In this case, distance 81 is more than twice distance 83, although such distance may vary with the gap placement.

Figure 8:
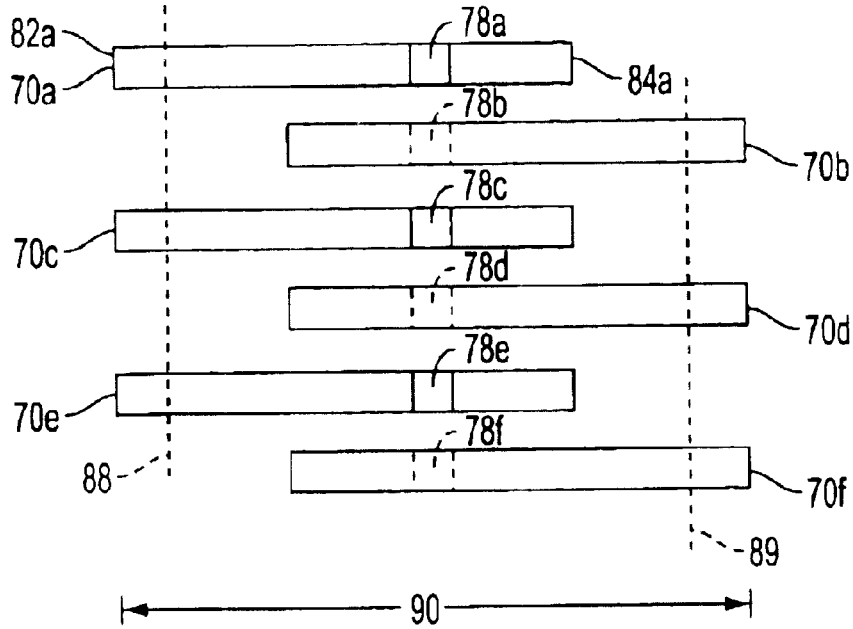
FIG. 8 illustrates the intertwining of links of FIG. 7 to form a chain of the present invention.

FIG. 8 illustrates one method of the intertwining of links 70*a*–70*f* via their gaps 78*a*–78*f* in accordance with the teachings of the invention. In this case, the links are alternately intertwined with each successive gap facing the opposite direction. This is illustrated in FIG. 8, wherein link gaps 78*a*, 78*c* and 78*e* are facing up, while the remaining gaps 78*b*, 78*d* and 78*f* are facing down. This results in a completed chain having a chain width 90 that is greater than the distance between the outermost points 82*a*, 84*a* as illustrated on first link 78*a* of FIG. 8. Actually, in the chain of FIG. 8, chain width 90 is determined to be twice the greater of the distance 81 or 83, or twice the largest distance between the gap plane 80 and the one of the outermost points 82, 84. In this case, chain width 90 is twice the distance 81, or twice the distance between the gap plane 80 and the outermost point 82.

Figure 5:
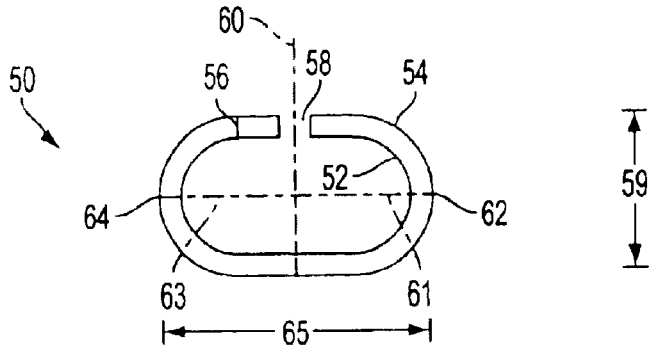
FIG. 5 (PRIOR ART)
FIG. 5 is a front view of a prior art link of the present invention.
Figure 6:
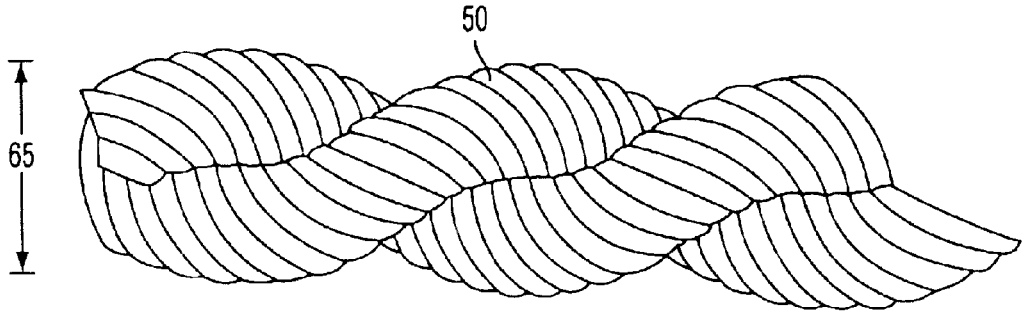
FIG. 6 (PRIOR ART)
FIG. 6 illustrates a front view of a chain formed by intertwining links illustrated in FIG. 5.
Figure 9:
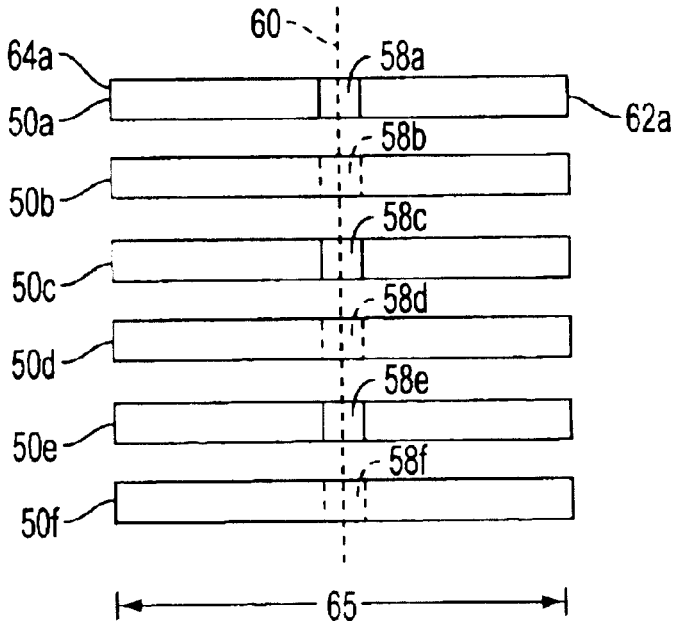
FIG. 9 (PRIOR ART)
FIG. 9 illustrates the intertwining of links of FIG. 5 to form a prior art chain.
Figure 10:
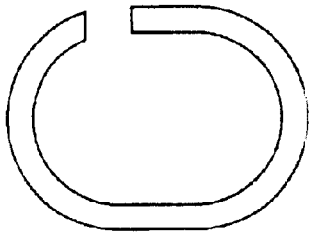
FIGS. 10–17 illustrate alternative embodiments of a link of the present invention.
Figure 11:
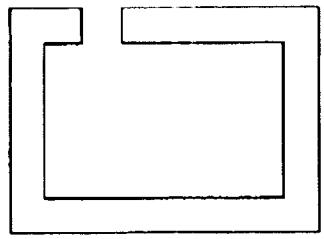
Figure 12:
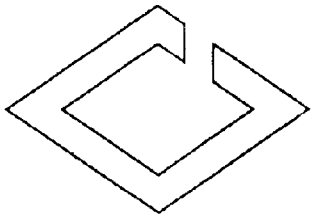
Figure 13:
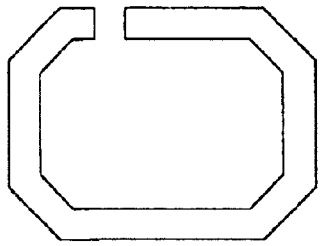
Figure 14:
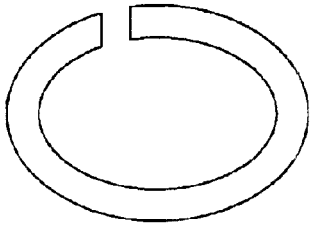
Figure 15:
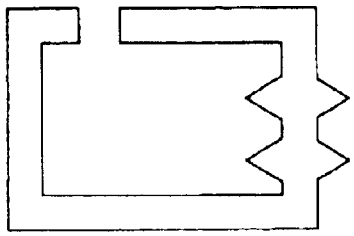

A comparison of the chain constructions of FIGS. 8 and 9 illustrates the difference between chains formed from a link of the present invention (FIG. 7) and a conventional link (FIG. 5). Links 50 (FIG. 5) and 70 (FIG. 7) are formed from the same amount of link material. In other words, the distance between the outermost points 62, 64 (defined along a major axis) of link 50 is the same as the distance between the outermost points 82, 84 of link 70. In addition, the thicknesses 56 and 76 of links 50, 70 are identical, while the link heights (defined along a minor axis) 59 (FIG. 5) and 79 (FIG. 7) are identical. FIGS. 8 and 9 are positioned relative to each other on the page so that the gaps 78*a*–78*f* and 58*a*–58*f* are aligned. It should thus be readily apparent that the chain thickness 65 from FIG. 9, formed from conventional chain links 50, is less than the chain thickness 90 from FIG. 8, formed from links 70 of the present invention. Thus, the width of a resultant chain can be increased by modifying the location of the gap relative to a centerline plane that cuts the link in half and relative to the outermost points on the link that define the chain width, without increasing the amount of link material used to create the chain.

It should be appreciated that a link of the present invention may be formed from a solid or hollow wire as is known in the art, or may be formed by stamping or punching as is also known in the art. Other methods may also be used. Also, it will be understood that while wires and links of certain shapes, profiles and cross-sectional configurations are used herein for purposes of illustration herein, any shaped wire and any shaped link (see FIGS. 10–17) with any shaped cross-section may be used. Furthermore, the gap is preferably located in a longer side of the link, i.e., facing the major axis of the link, and the gap plane is generally defined along a vertical that is perpendicular to such major axis.

Figure 16:
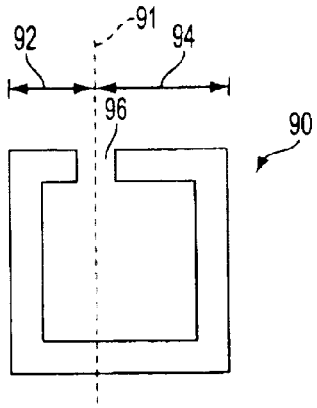
Figure 17:
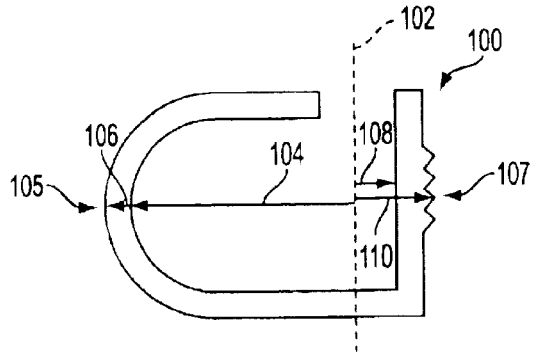

FIG. 16 illustrates that a link 90 does not have to be elongated as shown in some of the link examples of FIGS. 10–17, for example, as long as the gap 96 is eccentrically located or offset from the center of the link and the distances 92, 94 from the edge of the link 90 relative to the gap plane 91 are unequal. FIG. 17 (and also FIG. 15) illustrate a link variation wherein at least one side of the link 100 is formed with the same inner and outer profile or shape 104, 106 relative to the gap plane 102, with the other side having an inner and outer profile or shape 108, 110 that differ from one another.

Figure 1:
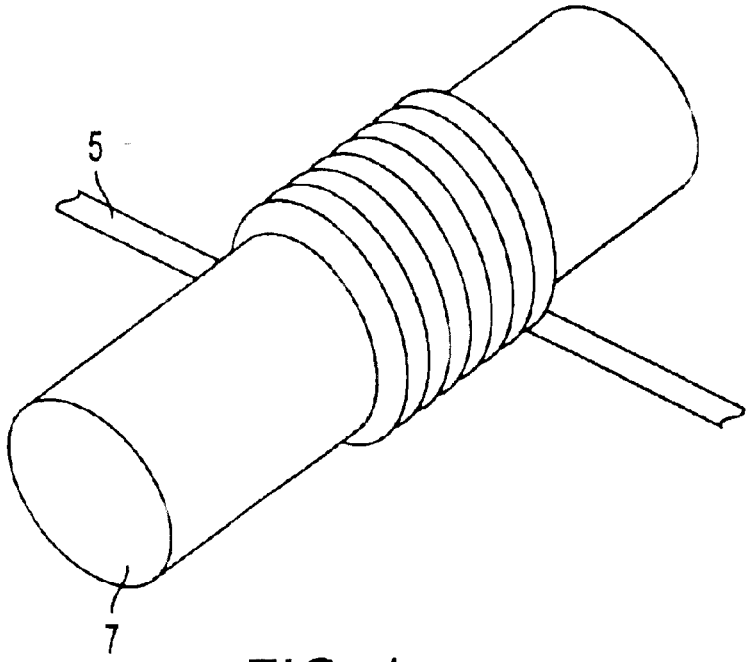
FIG. 1 (PRIOR ART)
FIG. 1 is an isometric view of a wire wound around a support illustrating a prior art method of forming links for the assembly of rope chains.
Figure 2:
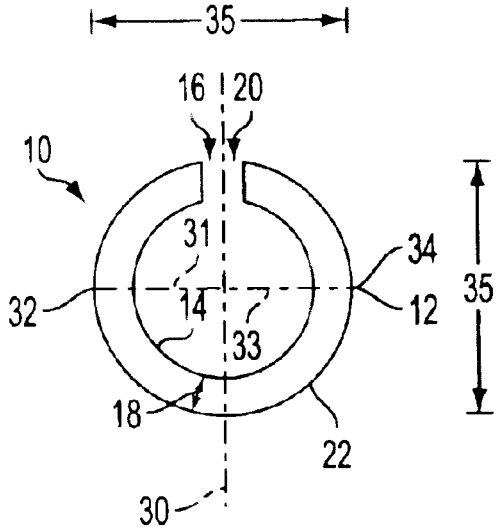
FIG. 2 (PRIOR ART)
FIG. 2 is a front view of a prior art link used in the assembly of rope chains.
Figure 18:
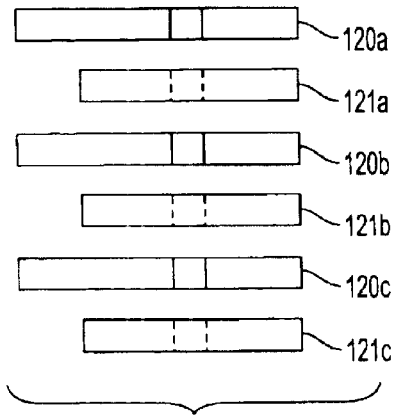
FIG. 18 illustrates an alternative embodiment of a chain formed in accordance with the present invention.

In addition, a chain formed in accordance with the present invention may comprise all of the same links, a plurality of different links, or groupings of different links. For instance, a chain may be formed from a continuous series of groupings of links illustrated in FIG. 11, followed by groupings of links illustrated in FIG. 13, followed by groupings of links illustrated in FIG. 10. As shown in FIG. 18, a chain may even be formed by intertwining links 120(*a*–*c*) of the present invention having an offset gap with prior art links 121(*a*–*c*) having a gap centered along the link centerline plane (see link 10 of FIG. 2). The links of the present invention may also be contoured, deformed, faceted or otherwise modified as known in the art and at any point during, before or after chain construction in order to enhance its decorative appearance.

A chain constructed in accordance with the method of the present invention may also be contoured in unique ways. For instance, the chain of FIG. 8 may be contoured or faceted so that every other link is contoured, resulting in a combination of faceted and unfaceted links. For instance, a contouring instrument of any type known in the art applied along planes 88 and 89 of the chain of FIG. 8 would facet only the edges 82 situated farthest from the gap plane 80, while the edges 84 closest to the gap plane 80 would remain unfaceted. Thus, an alternating link faceting arrangement may result from a conventional faceting stroke that is applied along the entire periphery of a chain, which alternating link faceting appearance would otherwise only be possible by altering the contouring instrument to contour every other link.

FIGS. 18–21 illustrate another method of intertwining links of the present invention to form a jewelry chain of the invention. Instead of intertwining links in an alternating fashion as shown in the chain of FIG. 8, the links of FIGS. 18–21 are intertwined in a non-alternating fashion with the gaps aligned as is known in the art of rope chain manufacture.

Figure 3:
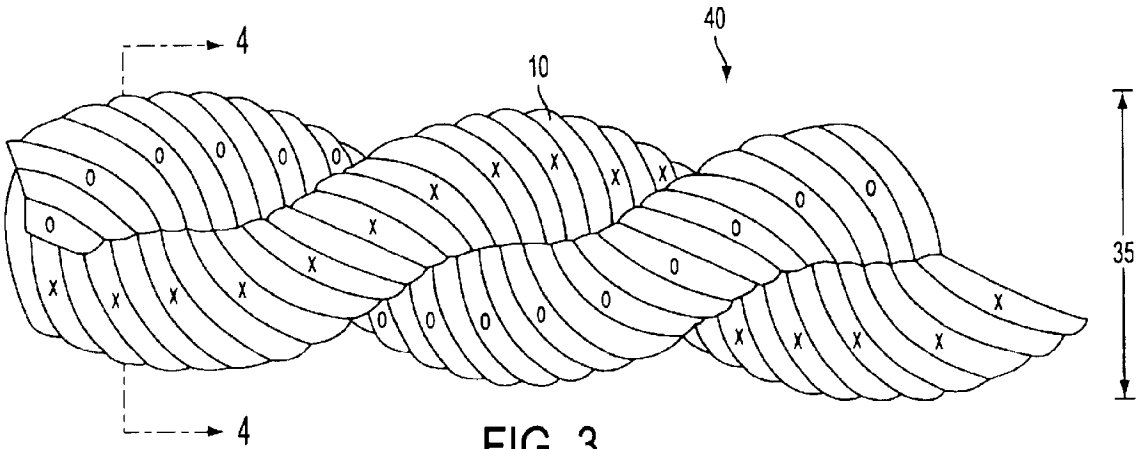
FIG. 3 (PRIOR ART)
FIG. 3 is a front view of a rope chain formed by intertwining links of FIG. 2.
Figure 4:
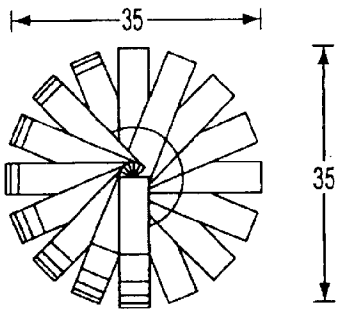
FIG. 4 (PRIOR ART)
FIG. 4 is a cross section taken through line 4—4 in FIG. 3.
Figure 19:
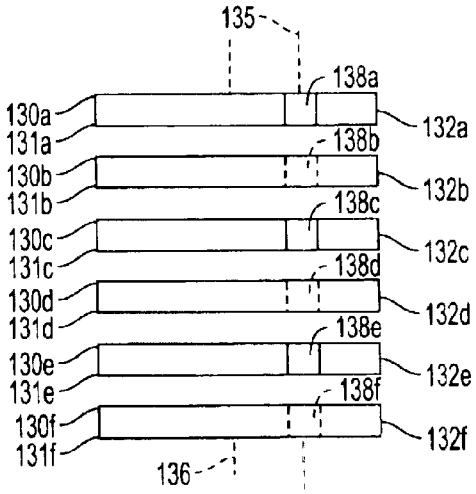
FIG. 19 illustrates a diagrammatic embodiment of a chain formed in accordance with the present invention.
Figure 20:
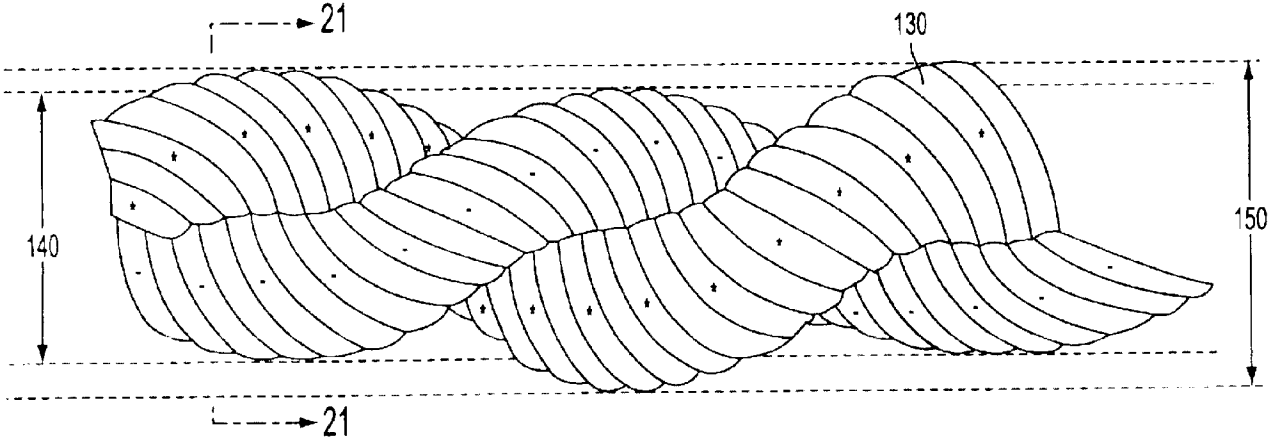
FIG. 20 illustrates a front view of a chain formed by intertwining links illustrated in FIG. 19.
Figure 21:
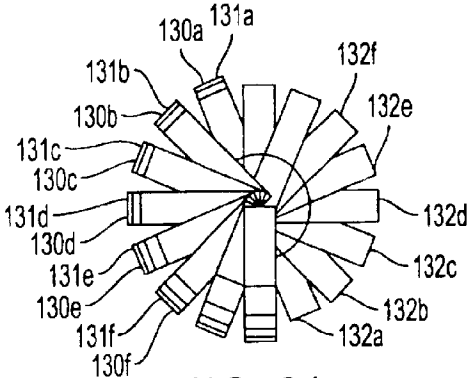
FIG. 21 is a cross section taken through line 21—21 in FIG. 20.

FIG. 19 illustrates the non-alternating intertwining of links 130 (shown as individual links 130*a*–130*f*) via their gaps 138*a*–138*f* in accordance with the teachings of the invention, which results in a completed chain as illustrated in FIG. 20. Link 130 is similar in configuration to link 70 of FIG. 7, wherein the gap plane 135 (FIG. 19) is offset from the centerline plane 136. Taking a cross-section through a completed chain as shown in FIG. 21, and due to the non-alternating intertwining, all of the outermost edges 131*a*–131*f* of the links 130 are situated adjacent each other while all of the outermost edges 132*a*–132*f* are situated adjacent each other. Because the edges 131*a–f* are situated farther away from the gap plane 135 than the edges 132*a–f*, the resultant chain illustrated in FIG. 20 appears to be formed from two distinct "helixes" of links, one helix designated by an asterisk "*" and formed from the edges 131*a–f*, etc. and the other designated by a dash "-" and formed from the edges 131*a–f*, etc., the "*" helix extending further outward from the chain center than the "-" helix. The "-" chain helix has a chain thickness 140, while the "*" chain helix has a chain thickness 150. The disparity in distances 140 and 150 is related to the extent of the offset of the gap plane 135 relative to the outermost points of the link and relative to the centerline plane 136 of such links, which is in clear contrast to a conventional chain construction illustrated in FIG. 3, with "○" and "x" helixes having a uniform helix diameter 35 without any dimensional disparities.

Thus, by non-alternately intertwining links having an offset gap, one can produce a jewelry chain having a unique outer appearance that is reflective of two different, intertwined chains. Of course, additional chains could be produced by modifying the method of intertwining individual links and/or groupings of links. For instance, single links or groupings of alternately intertwined links as shown in FIG. 8, could be intertwined with single links or groupings of non-alternately intertwined links as shown in FIG. 19 to form a composite chain (not shown) formed from both alternately and non-alternately intertwined links. In addition, prior art links that do not have an offset gap could be intertwined with links having an offset gap to produce a chain shown by way of example in FIG. 18, which could have a variety of intertwined appearances.

The manner in which the chain is constructed affects the manner in which the chain may be faceted or contoured. For example, in the chain of FIG. 20 formed from the links 130 of FIG. 19, a contouring apparatus could be applied to the chain adjacent the diameter 140, such that only the outer edges of the wider "*" helix are contoured, leaving the narrower "-" helix uncontoured. Of course, by varying the depth of the contouring apparatus relative to the completed chain, one can vary the extent to which the contouring is applied to the "*" and "-" helixes.

Similarly, the appearance of a contoured chain can be fabricated without actually contouring the completed chain. For instance, if the chain of FIG. 20 is formed from the non-alternate intertwining of links 100 of FIG. 17, the wider helix "*" would have a rounded appearance reflective of the contour or shape of edge 105 (FIG. 17), while the narrower helix "-" would have a jagged (contoured) appearance reflective of the contour or shape of the edge 107 (FIG. 17). Similarly, if the link of FIG. 15 were used to form a chain of FIG. 20, the wider helix "*" would have a jagged appearance while the narrower helix "-" would have a flat appearance, each helix reflective of a type of outer contour. Thus, the appearance of the helix "contours" could be dictated by the appearance of the outermost edges of the chain links, and not by any contouring applied to the chain after formation of the chain.

Again, a chain formed in accordance with the present invention may comprise hollow or solid links having various shapes, sizes, contours and cross sections. A chain may be formed from series or groupings of links of the present invention, intertwined with other links of the invention having different shapes, and further intertwined with prior art links if desired. The links may be intertwined in an alternate fashion, a non-alternating fashion, or by other means known in the art, one example illustrated in U.S. Pat. No. 4,934,135. The links of the present invention may also be contoured, deformed, faceted or otherwise modified as known in the art and at any point during, before or after chain construction in order to enhance its decorative appearance.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A jewelry chain link suitable for intertwining with other jewelry chain links to form a jewelry chain comprising:

a) an inner periphery, an outer periphery, a thickness defined between said inner periphery and said outer periphery and a gap extending between said inner and outer peripheries for intertwining one jewelry chain link with another, and b) a gap plane defined along a vertical and through a center of said gap, said gap having gap edges that are parallel to the gap plane, c) said inner and outer peripheries each including first and second inner and outer peripheral edges respectively on opposite sides of said gap plane and a connecting edges opposite said gap and disposed between said first and second inner and outer peripheral edges, d) said first outer peripheral edge and said first inner peripheral edge each having a first outermost dimension measured along a first lateral plane extending perpendicularly from said gap plane, e) said second outer peripheral edge and said second inner peripheral edge each having a second outermost dimension measured along a second lateral plane extending perpendicularly from said gap plane, and f) said first outermost dimension of each of said first outer and inner peripheral edges differing from said second outermost dimension of each of said second outer and inner peripheral edge respectively.

2. A jewelry chain link in accordance with claim 1, further comprising a substantially uniform thickness throughout said link.

3. A jewelry chain link in accordance with claim 1, wherein one of said first and second outermost dimensions is greater than twice the other dimension.

4. A jewelry chain link in accordance with claim 1, further comprising at least one concave surface in one of said outer peripheral edges.

5. A jewelry chain link in accordance with claim 1, further comprising at least one planar surface in one of said outer peripheral edges.

6. A jewelry chain link in accordance with claim 1, wherein said jewelry chain link has a non-uniform thickness.

7. A jewelry chain link in accordance with claim 1, wherein said first plane extends along a diameter of said link.

8. A jewelry chain link in accordance with claim 1, wherein said first and second planes are different.

9. A jewelry chain link in accordance with claim 1, further comprising a major axis and a minor axis, said gap plane extending perpendicular to said major axis and parallel to said minor axis.

10. A jewelry chain link suitable for intertwining with other jewelry chain links to form a jewelry chain, comprising:

a) an inner periphery, an outer periphery, a thickness defined between said inner periphery and said outer periphery and a gap extending between said inner and outer peripheries for intertwining one jewelry chain link with another, b) first and second outermost edges defined on said outer periphery, first and second outermost edges defined on said inner periphery, c) a gap plane defined along a vertical and through a center of said gap, said gap having gap edges that are parallel to the gap plane, d) said first outermost edge of each of said outer and inner peripheries respectively having a first outermost dimension measured relative to said gap plane, e) said second outermost edge of each of said outer and inner peripheries respectively having a second outermost dimension measured relative to said gap plane, and f) said first outermost dimension of each of said first outer and inner peripheries differing from said second outermost dimension of each of said second outer and inner peripheries respectively.

11. A jewelry chain link in accordance with claim 10, further comprising a substantially uniform thickness.

12. A jewelry chain link in accordance with claim 10, wherein said second outermost dimension of said outer or inner periphery is greater than twice the first outermost dimension of said outer or inner periphery.

13. A jewelry chain link in accordance with claim 10, wherein said jewelry chain link has a non-uniform thickness.

14. A jewelry chain link in accordance with claim 10, wherein outermost points defined along said first and second outermost edges of said outer and inner peripheries respectively fall on a diameter of said jewelry chain link.

15. A jewelry chain link in accordance with claim 10, wherein outermost points defined along said first and second outermost edges of said outer and inner peripheries respectively fall on different planes.

16. A jewelry chain link in accordance with claim 10, further comprising a major axis and a minor axis, said gap plane extending perpendicular to said major axis and parallel to said minor axis.

17. A jewelry chain comprising:

a) a plurality of intertwined chain links, each chain link comprising:

i. an inner periphery, an outer periphery, a thickness defined between said inner periphery and said outer periphery and a gap extending between said inner and outer peripheries for intertwining one chain link with another to form said jewelry chain, ii. a gap plane defined along a vertical and through a center of said gap, iii. first and second outermost edges defined on said outer periphery and defining a link width therebetween, iv. first and second outermost edges defined on said inner periphery, and v. wherein said first outermost edges of said outer and inner peripheries respectively differ in dimension with respect to said gap plane relative to said second outermost edges of said outer and inner peripheries respectively, and b) a chain width defined between outermost points of two successively intertwined chain links, said chain width being greater than said link width.

18. A jewelry chain in accordance with claim 17, wherein said first outer outermost edges of said outer and inner peripheries respectively each have a first outermost dimension measured along a first plane extending perpendicularly from said gap plane, said second outermost edges of said outer and inner peripheries respectively each have a second outermost dimension measured along a second plane extending perpendicularly from said gap plane, and said chain width being defined by twice the greater of the first and second outermost dimensions of said outer periphery.

19. A jewelry chain in accordance with claim 17, wherein each link further comprises a uniform thickness.

20. A jewelry chain in accordance with claim 17, wherein at least one chain link has a non-uniform thickness.

21. A jewelry chain in accordance with claim 17, further comprising groupings of chain links having different outer peripheral configurations.

22. A jewelry chain in accordance with claim 17, wherein said jewelry chain is a rope chain.

23. A jewelry chain in accordance with claim 18, wherein each chain link further comprises a major axis and a minor axis, said gap plane extending through a center of said gap and along an axis that is perpendicular to said major axis and parallel to said minor axis.

24. A method of producing jewelry chains comprising the steps of:

a) providing a chain link having:

i. an inner periphery, an outer periphery, a thickness defined between said inner periphery and said outer periphery and a gap extending between said inner and outer peripheries for intertwining one chain link with another to form said jewelry chain, ii. a gap plane defined along a vertical and through a center of said gap, iii. first and second outermost edges defined on said outer periphery and defining a link width therebetween, iv. first and second outermost edges defined on said inner periphery, and v. wherein said first outermost edges of said outer and inner peripheries respectively differ in dimension with respect to said gap plane relative to said second outermost edges of said outer and inner peripheries respectively, and b) intertwining said chain link with other chain links to form a jewelry chain, c) wherein a chain width is defined between outermost points of successively intertwined chain links when viewing said jewelry chain from the side, said chain width being greater than said link width.

25. A method of producing jewelry chains in accordance with claim 24, wherein said jewelry chain link is provided by stamping.

26. A method of producing jewelry chains in accordance with claim 24, wherein said jewelry chain link is provided by segmenting a wire coiled on a support.

27. A method of producing jewelry chains in accordance with claim 24, wherein said jewelry chain links are intertwined to form a jewelry rope chain.

28. A jewelry chain comprising:

a) a plurality of intertwined chain links, each chain link comprising:

i. an inner periphery, an outer periphery, a thickness defined between said inner periphery and said outer periphery and a gap extending between said inner and outer peripheries for intertwining one chain link with another to form said jewelry chain, ii. first and second outermost edges defined on said outer periphery and defining a link width therebetween, first and second outermost edges defined on said inner periphery, and iii. a gap plane defined through said gap, said first outer outermost edge of each of said outer and inner peripheries respectively having a first outermost dimension measured along a first plane extending perpendicularly from said gap plane, said second outermost edge of each of said outer and inner peripheries respectively having a second outermost dimension differing from said first outermost dimension of said respective outer and inner peripheries and measured along a second plane extending perpendicularly from said gap plane, and b) a chain width defined between outermost points of said plurality of intertwined chain links when said jewelry chain is viewed from the side, c) said chain width being greater than said link width.

29. A jewelry chain in accordance with claim 28, wherein said plurality of intertwined chain links are alternately intertwined and said chain width is defined by twice the greater of the first and second outermost dimensions of said first and second outermost edges of said outer periphery.

30. A jewelry chain in accordance with claim 28, wherein said plurality of intertwined chain links are non-alternately intertwined and said chain width is defined by the greater of the first and second outermost dimensions of said first and second outermost edges of said outer periphery.

31. A jewelry chain in accordance with claim 28, wherein said jewelry chain is a rope chain.

32. A jewelry chain having the appearance of a double helix comprising:

a) a plurality of intertwined chain links, each chain link comprising:

i. an inner periphery, an outer periphery, a thickness defined between said inner periphery and said outer periphery and a gap extending between said inner and outer peripheries for intertwining one chain link with another to form said jewelry chain, ii. first and second outermost edges having first and second shapes and defined on said outer periphery and defining a link width therebetween, iii. first and second outermost edges defined an said inner periphery, iv. a gap plane defined along a vertical and through a center of said gap, v. wherein said first outermost edges of said outer and inner peripheries respectively differ in dimension with respect to said gap plane relative to said second outermost edges of said outer and inner peripheries respectively, and b) a first helix contour defined by said first shape and having a first helix diameter, and c) a second helix contour defined by said second shape and having a second helix diameter differing from said first helix diameter.

33. A jewelry chain in accordance with claim 32, wherein said first outer outermost edge of said outer and inner peripheries respectively each have a first outermost dimension measured along a first plane extending perpendicularly from said gap plane, said second outermost edges of said outer and inner peripheries respectively each have a second outermost dimension differing from said first outermost dimension and measured along a second plane extending perpendicularly from said gap plane.

34. A method of producing a jewelry chain comprising the steps of:

a) providing a chain link having:

i. an inner periphery, an outer periphery, a thickness defined between said inner periphery and said outer periphery and a gap extending between said inner and outer peripheries for intertwining one chain link with another to from said jewelry chain, and ii. first and second outermost edges defined on said outer periphery and defining a link width therebetween, first and second outermost edges defined on said inner periphery, and iii. a gap plane defined through said gap, said first outer outermost edge defined on each of said outer and inner peripheries respectively each having a first outermost dimension measured along a first plane extending perpendicularly from said gap plane, said second outermost edge defined on each of said outer and inner peripheries respectively each having a second outermost dimension differing from said first outermost dimension and measured along a second plane extending perpendicularly from said gap plane, b) intertwining said chain link with other similarly constructed chain links to form a jewelry chain, and c) applying a contouring apparatus to said jewelry chain at a depth that is less than the difference between the first and second outermost dimensions defined on said outer periphery so that only one of the first and second outermost edges defined on said outer periphery is contoured.

* * * * *